United States Patent [19]

Farney et al.

[11] Patent Number: 5,036,694

[45] Date of Patent: Aug. 6, 1991

[54] METHOD AND APPARATUS FOR BENDING THE FLANGE OF A WORKPIECE

[75] Inventors: Michael D. Farney, Derby; Richard H. Miller, Rose Hill, both of Kans.

[73] Assignee: The Boeing Company, Seattle, Wash.

[21] Appl. No.: 546,745

[22] Filed: Jul. 2, 1990

[51] Int. Cl.[5] ..... B21D 5/01

[52] U.S. Cl. ..... 72/389; 72/322; 72/373; 72/375; 72/381; 72/413; 72/473

[58] Field of Search ..... 72/173, 175, 322, 373, 72/374, 386, 389, 413, 459, 473, 474, 479, 480, 381

[56] References Cited

U.S. PATENT DOCUMENTS

| | | | |
|---|---|---|---|
| 2,971,224 | 2/1961 | Overholser | 72/322 |
| 3,400,567 | 9/1968 | Sirantoine | 72/371 |
| 3,442,114 | 5/1969 | Snowden | 72/479 |
| 4,356,718 | 11/1982 | Makino | 72/473 |

FOREIGN PATENT DOCUMENTS

| | | | |
|---|---|---|---|
| 0103919 | 6/1983 | Japan | 72/389 |
| 0174217 | 9/1985 | Japan | 72/389 |
| 0364966 | 1/1932 | United Kingdom | 72/473 |

*Primary Examiner*—David Jones

*Attorney, Agent, or Firm*—Finnegan, Henderson, Farabow, Garrett & Dunner

[57] ABSTRACT

A device for bending a workpiece having a substantially planar leg fixed to a substantially planar cap at an initial angle comprises a block bar having a rounded bending surface for contacting the leg of a workpiece and a punch for urging the leg of the workpiece against the rounded bending surface to vary the angle between the cap and the leg from the initial angle to a desired angle while simultaneously maintaining the substantially planar shape of the cap and the leg. A method for bending a workpiece having a substantially planar leg fixed to a substantially planar cap at an initial angle comprises positioning the workpiece adjacent a block having a rounded bending surface and urging the leg of the workpiece against the bending surface.

12 Claims, 3 Drawing Sheets

METHOD AND APPARATUS FOR BENDING THE FLANGE OF A WORKPIECE

BACKGROUND OF THE INVENTION

1. Brief Description of the Invention

The present invention relates to a device and method for bending a flange extending from a workpiece. More specifically, the invention relates to a device and method for selectively altering the angularity of a variety of extruded and L-shaped sheet metal parts.

2. Description of the Related Art

Three general approaches exist for angularly altering the flange of a workpiece. According to a first approach, numerous brake bars are selectively placed in a press brake in order to produce different workpieces having varying angularly bent flanges. Each brake bar must be manufactured with an angled portion reasonably close to the desired angular bend of the flange of the workpiece in order to obtain the support required for bending. Such support is necessary to ensure that the point of bend during the angle altering operation is as close as possible to the intersection point of the flange with the workpiece. This ensures that both the flange and the cap of a workpiece maintain a substantially planar shape. There are a number of drawbacks to this approach. First, an extensive catalog of brake bars is necessary which may become very expensive. In addition, in situations where a number of different parts must be manufactured using the same press brake, this approach requires considerable down time for removing and installing various brake bars.

According to a second approach, a brake bar similar to the one depicted in FIG. 3 can be made with a nonspecific or generic angle and can be used to form a variety of angled parts. This approach sacrifices the quality of an altered part by reducing or eliminating the necessary support to achieve the proper point of bend. With the second approach, bending may occur at an improper location, or a roll rather than a bend may be formed in the flange.

According to a third approach, a form die (shown in FIG. 4) is used and includes a pair of mating surfaces which are urged together to bend the flange therebetween. A drawback of this approach is that a separate die is required for each part having a different angular bend.

Another drawback common to each of the above described approaches is that the dies used are manufactured to accommodate parts of specific thicknesses. Thus, in order to achieve the same angular alteration in a number of parts having various thicknesses, it is necessary to use a different brake bar tailored to the thickness of each part.

The present invention provides an improved device and method for altering the angular dimensions of a workpiece. According to the present invention, a single brake bar that can accommodate workpieces having various thicknesses can be used to bend the flange of a workpiece to an infinite number of angles.

Advantages of the invention are set forth in part in the description which follows, and in part will be obvious in the description, or may be learned by practice of the invention.

SUMMARY OF THE INVENTION

An object of the invention is to provide an improved device and method for altering the flange of a workpiece to a plurality of angles.

Another object of the present invention is to provide a method and device that is capable of accepting workpieces of various thicknesses.

It is a further object of the present invention to provide a device and method that substantially eliminates the requirements for an extensive catalog of brake bars and improves the finished quality of altered parts.

Additional objects and advantages of the invention will be set forth in part in the description which follows and, in part, will be obvious from the description or may be learned by practice of the invention. The objects and advantages will be realized and attained by means of the elements and combinations particularly pointed out in the appended claims.

To achieve the objects and in accordance with the purposes of the invention as embodied and broadly described herein, the invention includes a device for bending a workpiece having a substantially planar leg fixed to a substantially planar cap at an initial angle, the device comprising block means having a rounded bending surface for contacting the leg of a workpiece, and means for urging the leg of the workpiece against the rounded bending surface to vary the angle between the cap and the leg from the initial angle to a desired angle while simultaneously maintaining the substantially planar shape of the cap and the leg.

Preferably, the device includes a back plate disposed proximate the block means, and defines a bending space disposed between a portion of the rounded bending surface and the back plate. It is preferable for the device to also include means for selectively varying the distance between the block means and the back plate.

The method of the invention comprises the steps of positioning the workpiece adjacent a block having a rounded bending surface, and urging the leg of the workpiece against the bending surface to vary the angle between the cap and the leg from the initial angle to a desired angle while simultaneously maintaining the substantially planar shape of the cap and the leg.

In a preferred embodiment, the subject method also includes the step of adjusting the distance between the block and the back plate to correspond to a thickness of the cap.

It is to be understood that both the foregoing general description and the following detailed description are exemplary and explanatory only and are not restrictive of the invention, as claimed.

The accompanying drawings, which are incorporated in and constitute a part of the specification, illustrate a preferred embodiment of the invention and together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings.

Figure 1:
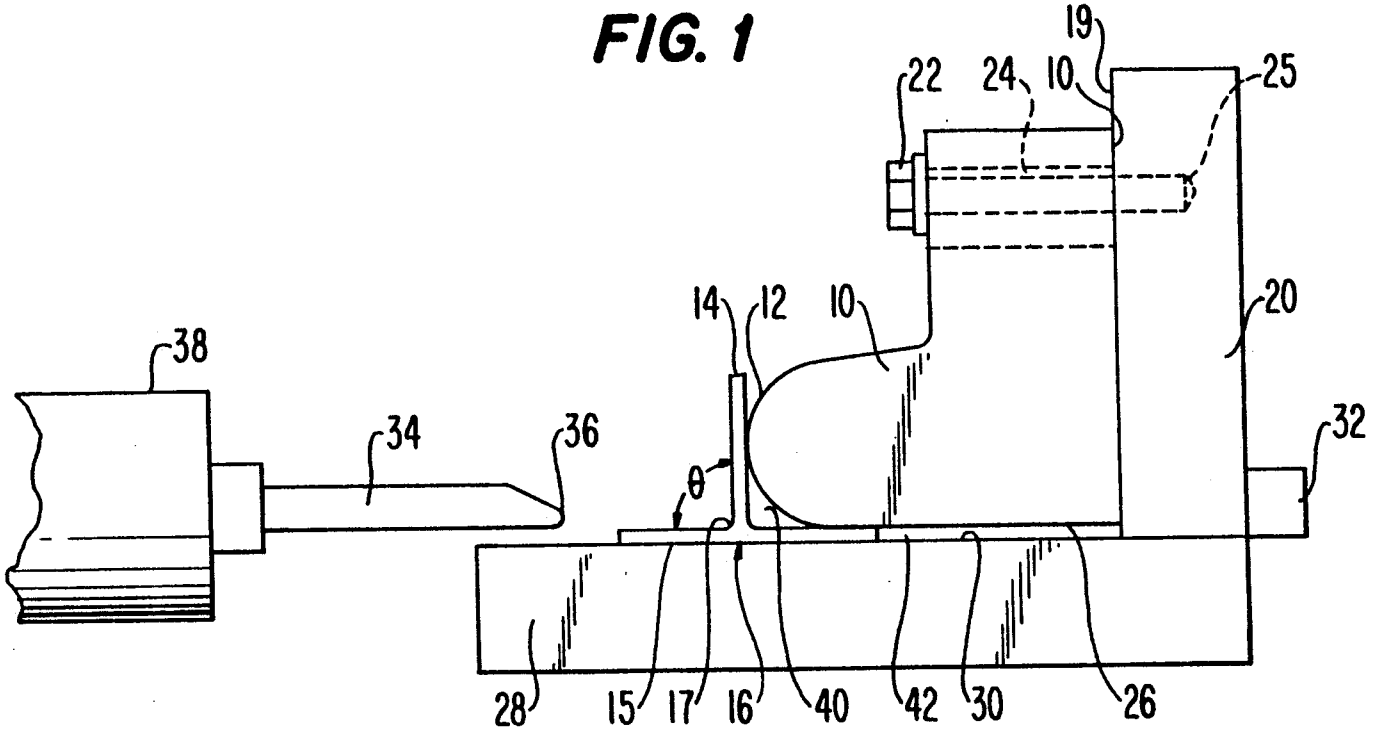
FIG. 1 is a schematic diagram of a bending device in accordance with the present invention.
Figure 2C:
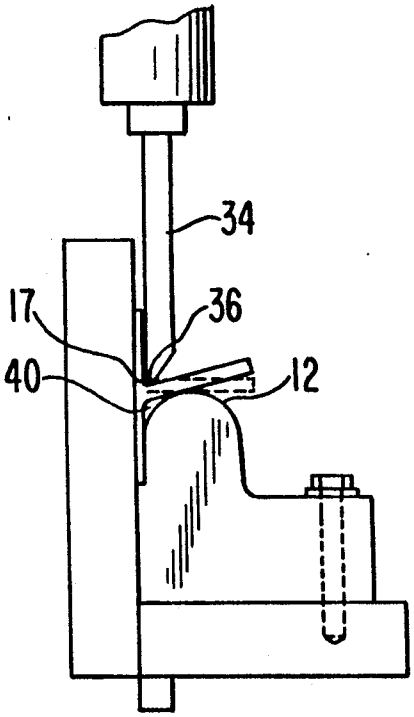
FIGS. 2*a*–2*c* illustrate sequential steps in accordance with the method of the present invention.
Figure 2B:
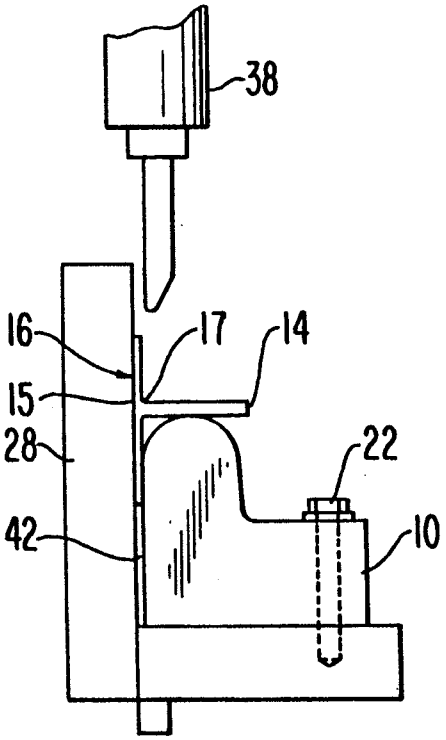
Figure 2A:
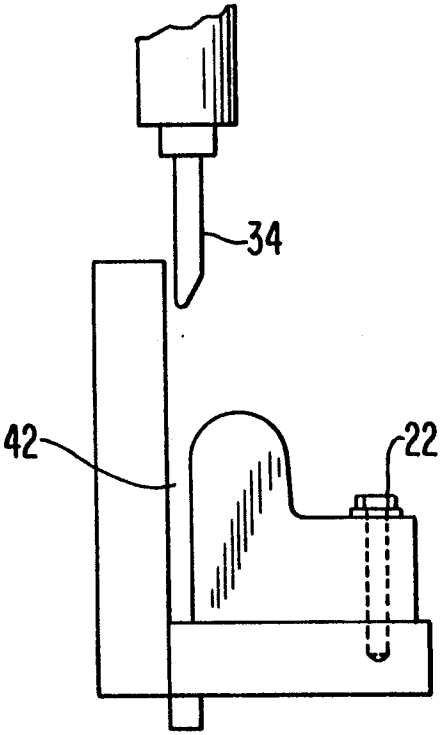
Figure 3:
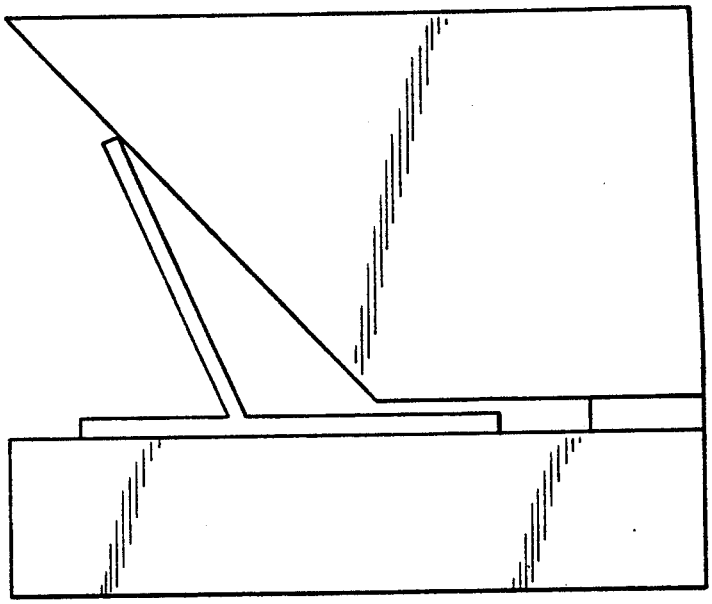
FIG. 3 (RELATED ART)
FIG. 3 is a related art alter angle brake bar.
Figure 4:
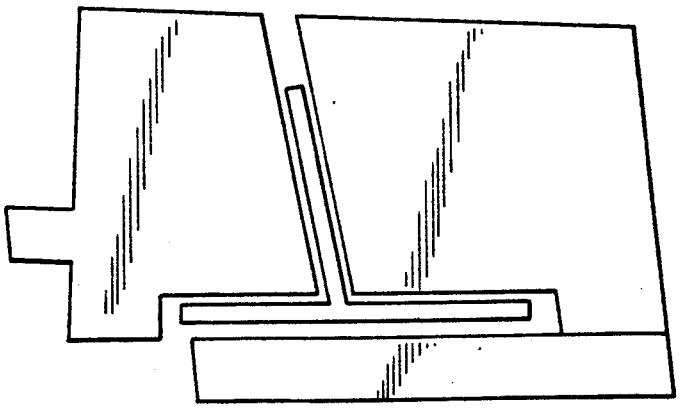
FIG. 4 (RELATED ART)
FIG. 4 is a related art form die.

In accordance with the present invention, a device for bending a workpiece having a substantially planar leg fixed to a substantially planar cap at an initial angle, comprises block means having a rounded bending surface for contacting the leg of a workpiece. As embodied herein, and as depicted in FIG. 1, block means includes block bar 10 having rounded bending surface 12 for contacting leg 14 of workpiece 16. Block bar 10 includes a sliding surface 18 disposed opposite rounded bending surface 12. Sliding surface 18 is disposed to slidingly engage a corresponding surface 19 of support member 20. Bolt 22 extends through elongated slot 24 in block bar 10 and threadingly engages an opening 25 in support member 20. Thus, when bolt 22 is tightened, block bar 10 is fixed to support member 20.

Block bar 10 also includes planar surface 26 extending between and connecting rounded bending surface 12 and sliding surface 18.

Back plate 28 is mounted to support member 20 and includes planar surface 30 disposed parallel to planar surface 26 of block bar 10. A space 42 for slidably receiving a portion of cap 15 is formed between planar surfaces 26 and 30. When bolt 22 is loosened, block bar 10 is movable to vary the dimensions of space 42 to correspond to caps of varying thicknesses. Bending space 40 is formed between rounded bending surface 12 and planar surface 30.

Key 32 extends from a surface of support member 20 opposite surface 19. Key 32 serves to secure support member 20 in position on a conventional press brake (not shown).

Also in accordance with the invention, there is provided means for urging the leg of the workpiece against the rounded bending surface to vary the angle between the cap and the leg from the initial angle to a desired angle while simultaneously maintaining the substantially planar shape of the cap and the leg. As embodied herein, urging means includes punch 34 having end 36 for urging leg 14 of workpiece 16 against rounded bending surface 12 to bend leg 14 relative to cap 15. Punch 34 is connected at an end opposite end 36 to actuator 38. Actuator 38 is selectively controllable to vary the distance that end 36 of punch 34 travels into bending space 40. As actuator 38 is adjusted to drive end 36 deeper into bending space 40, angle $\theta$ between leg 14 and cap 15 decreases. Thus, actuator 38 can be adjusted to produce an infinite number of angles $\theta$ between leg 14 and cap 15.

The method of the present invention will now be described with reference to FIGS. *2a–2c*. The method of the present invention includes positioning a workpiece adjacent a block having a rounded bending surface. Initially, as shown in FIG. *2a*, the device of the present invention is in a standby position. Next, as shown in FIG. *2b*, leg 14 of workpiece 16 is positioned against rounded bending surface 12, and a portion of cap 15 is inserted in space 42 between back plate 28 and block bar 10. Bar block 10 is then urged towards back plate 28 to slidably sandwich a portion of cap 15 therebetween. Bolt 22 is then tightened so that space 42 is fixed to correspond to the thickness of cap 15.

Once workpiece 16 is secured in the bending device as shown in FIG. *2b*, actuator 38 drives end 36 of punch 34 against leg 14 at its connection point 17 with cap 15 as shown in FIG. *2c*. Actuator 38 is adjusted to drive end 36 a predetermined distance into bending space 40. As discussed above, this predetermined distance is directly related to the angle formed between leg 14 and cap 15. As punch 34 travels into bending space 40, cap 15 slides within space 42. At the same time, leg 14 rolls along rounded bending surface 12 remaining substantially tangential to rounded bending surface 12 throughout its roll.

The device and method of the present invention ensure that the substantially planar shape of the cap and the leg are maintained during bending. In addition, the device and method of the present invention ensure that bending occurs at connection location 17 between leg 14 and cap 15. Once leg 14 is bent, punch 34 is withdrawn to the position shown in FIG. *2a*, and workpiece 16 is removed from the bending device.

It will be apparent to those skilled in the art that various modifications and variations can be made to the above-described embodiments of the present invention without departing from the scope or spirit of the invention.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A device for bending a workpiece having a substantially planar leg fixed to a substantially planar cap at an initial angle, the device comprising:

a backplate having a substantially planar backplate surface;

a block spaced a predetermined distance from said backplate surface, the block having a rounded bending surface for contacting the leg of a workpiece, a portion of said rounded bending surface and said backplate surface cooperating to define a bending space therebetween; and means for urging a portion of the leg of the workpiece into said bending space to vary the angle between the cap and the leg from the initial angle to a desired angle while simultaneously maintaining the substantially planar shape of the cap and the leg, said urging means including a punch adapted for movement substantially parallel to said backplate surface.

2. A device as set forth in claim 1 further including means for selectively controlling the movement of said punch to thereby selectively vary said desired angle.

3. A device as set forth in claim 1 wherein said backplate is disposed a predetermined distance from said block means to define a space therebetween for slidably receiving a portion of the cap.

4. A device as set forth in claim 3 further including means for selectively varying the distance between said block and said backplate.

5. A device as set forth in claim 3 further including a support member mounted on said backplate, said block being mounted on said support member.

6. A device as set forth in claim 5 further including means for movably mounting said block on said support member to selectively adjust the distance between said block and said backplate.

7. A device as set forth in claim 6 wherein said means for movably mounting includes at least one elongated slot disposed in said block and a bolt extending through said slot for threadingly engaging an opening in said support member.

8. A device for bending a workpiece having a substantially planar leg connected to a substantially planar cap at an initial angle, the device comprising:

a backplate having a substantially planar backplate surface;

a support member mounted on said backplate;

a block adjustably mounted on said support member for variably adjusting the distance between said block and said backplate surface, said block having a rounded bending surface for contacting the leg of a workpiece, a portion of said rounded surface and said backplate surface cooperating to define a bending space therebetween; and means for urging the leg of the workpiece against said rounded bending surface to vary the angle between the cap and the leg from the initial angle to a desired angle, said urging means including a punch adapted for movement substantially parallel to said surface of said backplate.

9. A die for disposition in press brake having a punch for exerting a bending force on the leg of a workpiece disposed in the die, the leg initially having a substantially planar shape and being fixed to a substantially planar cap, the die comprising:

a block having a rounded bending surface for contacting the leg of a workpiece;

a backplate having a substantially planar surface and being disposed adjacent said block for defining a bending space between said backplate and said rounded bending surface, said bending space for receiving a portion of the leg of the workpiece when the punch exerts a bending force thereon substantially parallel to the planar surface of the backplate, said block, said backplate and the punch cooperating to maintain the substantially planar shape of the leg and the cap when the bending force is exerted by the punch.

10. A method for bending a workpiece having a substantially planar leg fixed to a substantially planar cap at an initial angle, the method comprising the steps of:

positioning the workpiece adjacent a block having a rounded bending surface and against a backplate having a substantially planar surface; and driving a punch parallel to the surface of the backplate to urge a portion of the leg into a bending space between the backplate and the rounded bending surface of the block, to thereby vary the angle between the cap and the leg from the initial angle to a desired angle while simultaneously maintaining the substantially planar shape of the cap and the leg.

11. A method as set forth in claim 10 wherein the step of positioning includes inserting at least a portion of the cap of the workpiece between the block and a backplate.

12. A method as set forth in claim 11 further including the step of adjusting the distance between the block and the backplate to correspond to a thickness of the cap.

* * * * *